US005890701A

United States Patent [19]

Cavanagh

[11] Patent Number: 5,890,701

[45] Date of Patent: Apr. 6, 1999

[54] WATER SEALING ARRANGEMENT FOR A MARINE WINCH

[76] Inventor: Paul D. Cavanagh, 254 Middle Rd., Byfield, Mass. 01922

[21] Appl. No.: 20,528

[22] Filed: Feb. 9, 1998

[51] Int. Cl.[6] ..... B66D 1/00

[52] U.S. Cl. ..... 254/266; 242/319

[58] Field of Search ..... 254/266; 242/319, 242/904; 114/268, 218

[56] References Cited

U.S. PATENT DOCUMENTS

| | | | |
|---|---|---|---|
| 4,463,932 | 8/1984 | Shunker | 254/266 |
| 4,651,949 | 3/1987 | Sato | 242/217 |
| 4,805,849 | 2/1989 | Nanbu | 242/84.5 R |
| 5,573,193 | 11/1996 | Bernard et al. | 242/319 |

FOREIGN PATENT DOCUMENTS

| | | | |
|---|---|---|---|
| 8208198 | 12/1983 | Netherlands | 114/218 |

*Primary Examiner*—Donald P. Walsh
*Assistant Examiner*—Minh-Chau Pham
*Attorney, Agent, or Firm*—Dan Halgren

[57] ABSTRACT

The present apparatus includes an improved weather resistant marine winch arranged to permit the control of lines on a ship and to minimize water intrusion into the winch. The winch comprises a base for attachment to surface of the ship, the winch including a vertically oriented drive shaft supported over the base. A cylindrically shaped drum is rotatively disposed about the drive shaft, the drum having an upper drum flange and a lower drum flange. The upper drum flange has an upper hub portion on which an annular peeler bar is arranged. The peeler bar has a central bore with a shoulder therearound. A ring cap is fit about an upper end of the drive shaft, with a downwardly extending flange mating radially about the shoulder of the peeler bar. An annular "U" shaped groove is arranged about the outer periphery of the shoulder to divert any weather elements from infiltrating under the ring cap, thereby protecting the winch from the weather. Other annular seals are disposed between the lower flange and the base of the winch, and between the peeler bar and the central hub of the upper drum flange, as further water diversions between other rotating and stationary surfaces, to prevent infiltration of water into the inner workings of the winch.

7 Claims, 1 Drawing Sheet

WATER SEALING ARRANGEMENT FOR A MARINE WINCH

Background of the Invention

1. Field of the Invention

This invention relates to marine winches, and more particularly, to seals arranged within that winch to minimize water infiltration.

2. Prior Art

Marine winches such as may be found on sailing craft, working or utility boats or the like, are used to adjust lines or halyards, often under heavy loads. Such marine winches, which are sophisticated mechanical devices, are subject to exposure of sea elements, such as salt water, wind, rain and ice. A winch typically comprises a base element mounted at an appropriate location on a deck or surface structure of a boat. A winch typically comprises a vertically oriented drum which is usually manually energized by means of a crank operated gear train acting upon a drive shaft. A drive shaft is journalled and is fixedly connected to the drum, as by means of a splined shaft connection. Such a crank operated gear train is typically of the reduction gear type, and comprises a number of output speeds or mechanical advantages which may be selected by the user through the intermittent retrograde motion of the crank. The vertically oriented drum, which encloses the reduction gear mechanism therewithin, has a spool arranged therearound. The spool accepts multiple coils of line, to handle the sails of the boat or to pull a load.

Frequent use of such a winch in a hazardous marine environment, exposes that winch to the hazards of salt water and the like as aforementioned. The effects of salt water and its resultant corrosion and clogging effect, requires frequent disassembly, cleaning and maintenance of such marine winches exposed thereto.

It is an object of the present invention, to provide a marine winch arrangement, which minimizes the intrusion of water into the central workings of a marine winch.

It is yet a further object of the present invention to provide a marine winch assembly by which salt water and environmental intrusion is minimized in a most economical and efficient manner.

It is yet still further object of the present invention, to provide a seal and drain arrangement for a vertically oriented marine winch, which seal arrangement requires minimal machine and secondary attachments to effect the purposes of this invention.

BRIEF SUMMARY OF THE INVENTION

The present invention involves a marine winch with a gutter and labyrinth sealing system arranged to minimize the intrusion of salt and water elements from the inside of the winch. The marine winch comprises a generally circular base plate, which base plate is typically fixed to a deck or other exposed surface of a ship or sailboat. A vertically disposed drive shaft is rotatively supported at a central location on the base plate. The drive shaft has an upper end into which a handle may be affixed to rotate the drive shaft and drum. A plurality of planetary gears is arranged circumferentially about the drive shaft. The gears are enclosed and the drive shaft is engaged within the inner housing. The inner housing is generally circular, and is fixedly attached at its rim-like base, to the base plate. The housing includes an internal hollow shaft disposed annularly about the drive shaft. A generally cylindrically shaped drum is rotatably supported about the drive shaft. The drum has a bottom flange disposed adjacent to the periphery of the lower portion of the housing and base. The drum has an upper flange fixedly attached thereto. The upper and lower flanges define the upper and lower boundaries where line may be wrapped up about the drum. A clamp ring is arranged about the drive shaft and rests on the upper surface of the upper drum flange. A peeler or stripper bar is arranged on the uppermost end of the drive shaft and has a radially extending finger over which a line is fed prior to the wrapping of the line about the drum. A ring cap is similarly arranged about the uppermost end of the drive shaft having an annular flange extending downwardly, adjacent an upstanding ring on the innermost edge of the hub of the stripper or peeler bar. The downwardly extending flange is in close contact with the upstanding ring on the uppermost edge of the peeler bar, at its hub.

An inwardly directed channel or gutter is arranged as an annular groove adjacent the periphery of the upstanding ring at the hub of the peeler bar. The channel or gutter provides a first diversion to any water attempting to enter the winch, particularly that water which may be driven towards the end cap, to prevent or minimize any intervention of water or contamination adjacent the hub of the peeler or stripper bar.

The hub of the peeler or stripper bar itself has an outwardly directed edge having a downwardly extending flange therearound. The drum top has an inner hub portion having an uppermost peripheral flange thereon. The downwardly directed flange of the hub of the peeler bar and the uppermost edge of the flange of the hub of the drum top, have a narrow annular space arranged therebetween. There is relative motion between the hub and radially extending finger of the peeler and stripper bar and the upper end of the hub of the drum top. An annular channel is arranged within the radially outwardly directed edge of the upper end of the drum top hub. A flexible annular L-shaped seal is snuggly arranged in the channel within the hub of the drum top, as a second diversion to water infiltration into the winch. The L-shaped seal has a leg portion extending radially outwardly therefrom, in rubbing sealing contact with the downwardly extending flange at the periphery of the hub of the peeler and stripper bar. The flexible L-shaped seal, arranged between the top of the hub of the drum top and the downwardly extending flange of the peeler and stripper bar, acts as a flow restrictor to any contaminated sea water or environmental hazard which may try to infiltrate the area between the hub of the peeler and stripper bar and the hub of the drum top. This second seal thus prevents further infiltration of such contaminants, which might otherwise have a deleterious effect on the gearing mechanism within the drum and housing itself, of the present winch device.

The drum has an inner annular column, having a lower end that is supported on bearings which rides on a hub portion of the housing. The housing, as aforementioned, is fixedly attached to the base pate, which base plate is of course fixedly attached to the deck or planking of a ship or boat, in open engagement with any weather conditions. The lower portion of housing, called an annular rim, is attached to the base, and is of circular configuration. The annular rim of the housing has an annular wall with an annular groove disposed therearound, and for descriptive purposes herein, may be considered unitary with the base. The drum has a lowermost flange portion having a skirt, which extends readily outwardly of the annular groove on the rim of the housing/base. A generally V or L-shaped flexible annular seal is snuggly mated within the annular groove in the lower portion of the housing/base. The flexible generally L-shaped seal has a generally radially outwardly directed leg portion which is in abutting, rubbing contact with the inner side of the skirt extending downwardly from the lower end of the drum. The flexible annular seal arranged between the stationary base of the housing, and the rotatable peripheral skirt readily thereadjacent, provides a further labyrinthian seal at the juncture of those components, providing a further barrier or third diversion to infiltration of weather, salt, and seawater typically found in the environment to which the inventive winch is utilized.

The invention thus comprises an improved weather resistant marine winch arranged to permit the control of lines on a ship and to minimize water intrusion into the winch. The winch comprises a base for attachment to surface of the ship. The winch includes a vertically oriented drive shaft supported over the base. A cylindrically shaped drum is rotatively disposed about the drive shaft, the drum having an upper drum flange and a lower drum flange. The upper drum flange has an upper hub portion, on which an annular peeler bar is arranged. The peeler bar has a central bore with a shoulder therearound. A ring cap is fit about an upper end of the drive shaft, with a downwardly extending flange mating radially about the shoulder of the peeler bar. An annular "U" shaped groove is arranged about the outer periphery of the shoulder to divert any weather elements from infiltrating under the ring cap, thereby protecting the upper end of the drive shaft of the winch from the weather. The upper hub portion of the upper flange on the drum has an annular groove therearound. The peeler bar has an annular lip or flange radially thereadjacent the annular groove in the upper flange of the upper hub. A flexible annular seal, of "L" shape in cross-section, extends between the hub portion and the flange of the peeler bar to seal weather from entry within the area between the peeler bar and the hub portion of the upper flange of the drum. The lower flange of the drum has a downwardly extending skirt arranged in an overlapping relationship with a peripheral portion of the rim of the housing and/or the base plate. An annular groove is arranged in the peripheral portion of the rim/base, and a flexible "L" shaped seal ring is arranged in the annular groove in the peripheral rim portion of the base. The seal has a leg segment thereon extending generally radially outwardly in contact with an inner side of the skirt, to provide a weather sealing arrangement between lower flange of the drum and the base, to prevent weather intrusion therebetween.

Thus, what has been shown, is a novel seal arrangement to minimize the intrusion of environmental hazards into the inner workings of a marine winch. The seal arrangement is comprised of gutters or channels and or flexible barriers between adjacent spaced apart components or moving parts, to provide a multiple water diversion protection arrangement for a marine winch that is not shown or suggested in the art.

BRIEF DESCRIPTION OF THE DRAWINGS

The objects and advantages of the present invention will become more apparent, when viewed in conjunction with the following drawings, in which.

DESCRIPTION OF THE PREFERRED EMBODIMENTS

Figure 1A:
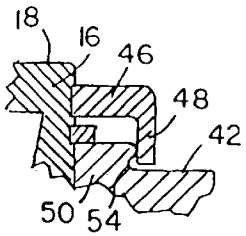
FIG. 1A is an enlarged sectional view of a water-diverting channel arrangement of the present invention.
Figure 1B:
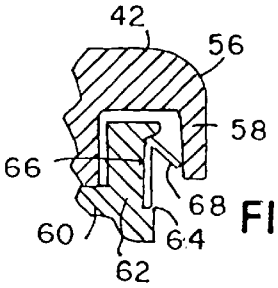
FIG. 1B is an enlarged sectional view of a flange and hub arrangement of a marine winch, constructed according to the principles of the present invention.
Figure 1C:
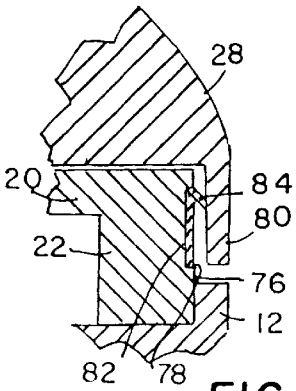
FIG. 1C is an enlarged sectional view of a drum and base portion of a marine winch constructed according to the principles of the present invention, having a further seal arrangement there between, thus providing a labyrinthian barrier to element intrusion.
Figure 1:
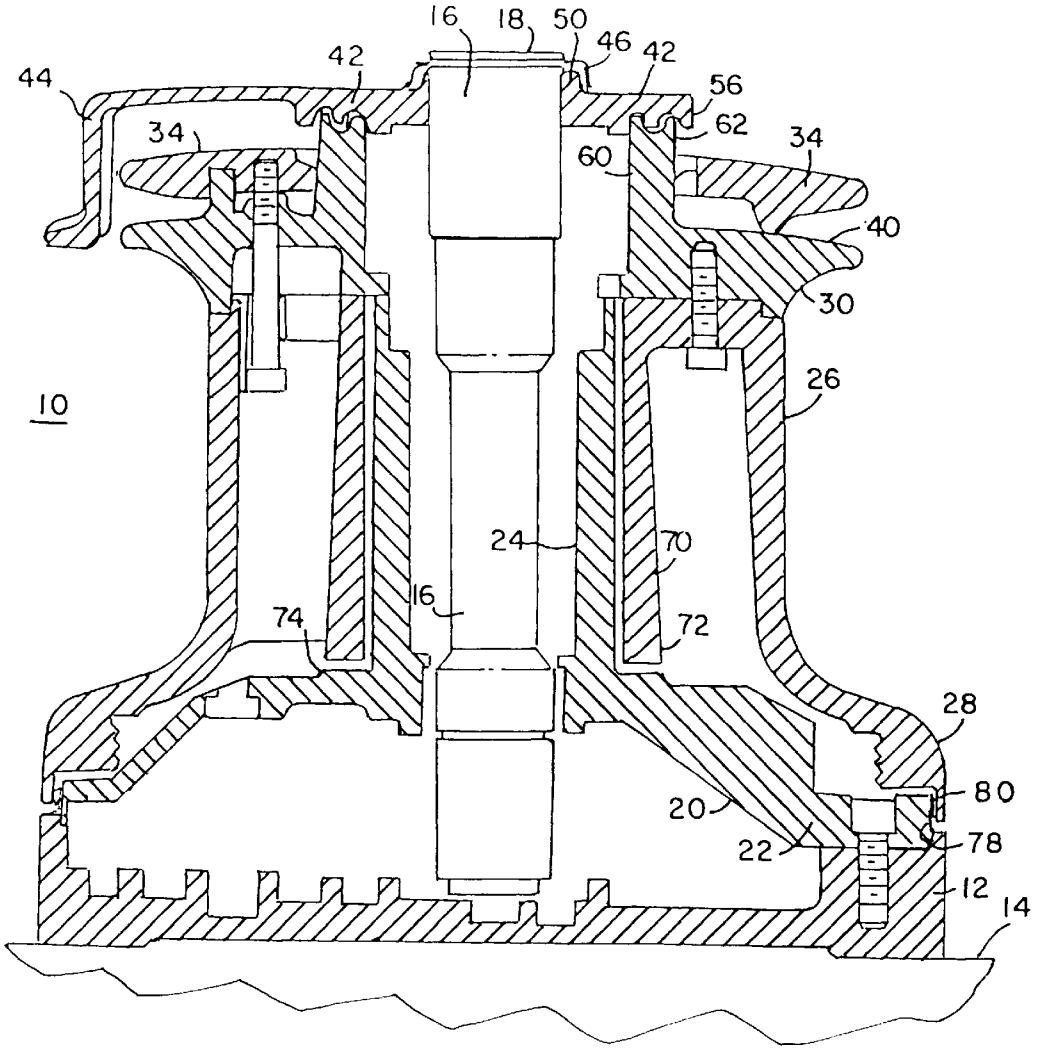
FIG. 1 is a side elevational view, in section, showing a marine winch constructed according to the principles of the present invention.

Referring now to the drawings in detail, and particularly to FIG. 1, there is shown the present invention which involves a marine winch 10 having a gutter and labyrinth sealing system arranged to minimize the intrusion of salt and water elements into the inside of the winch 10. The marine winch 10 comprises a generally circular base plate 12, which base plate 12 is typically fixed to a deck or other exposed surface 14 of a ship or sail boat. A vertically disposed drive shaft 16 is rotatively supported at a central location on the base plate 12. The drive shaft 16 has an upper end 18, into which a handle, not shown, may be affixed to rotate the drive shaft 16. A plurality of planetary gears, not shown, is arranged circumferentially about the drive shaft 16. The gears are enclosed by and the drive shaft 16 is engaged within an inner housing 20. The housing 20 is generally circular, and is fixedly attached at an annular rim 22, to the base plate 12. The housing 20 includes an internal shaft 24 disposed annularly about the drive shaft 16, as may be seen in FIG. 1. A generally cylindrically shaped drum 26 is rotatably supported about the drive shaft 16 in a known manner. The drum 26 has a unitary, radially outwardly directed bottom flange 28 disposed adjacent to the periphery of the lower portion of the housing 20. The drum 26 has a radially outwardly directed upper flange 30 fixedly attached thereto, as may be seen in FIG. 1. The upper and lower flanges 30 and 28 define the upper and lower boundaries where line may be wrapped around the drum 26.

A clamp ring 34 is arranged about the drive shaft 16 and rests on an upper surface 40 of the upper drum flange 30. A peeler or stripper bar 42 is arranged on the uppermost end of the drive shaft 16 and has a radially extending finger 44 over which a line is fed and peels off as it comes off of the drum 26. A flexible rubber-like ring cap 46 is similarly arranged about a groove 43 at the uppermost end of the drive shaft 16 and has an annular flange 48 extending downwardly, as may be seen more clearly in enlarged sectional view thereof, in FIG. 1A. The annular flange 48 is disposed radially outwardly adjacent an upstanding shoulder 50 on the uppermost edge of the hub of the stripper or peeler bar 42. The downwardly extending flange 48 is in close contact with the radially outer edge of the shoulder 50. An inwardly directed "U" shaped channel or gutter 54 is arranged as an annular groove made into the peripheral side of the shoulder 50, at the hub of the peeler bar 42, as may be seen in FIG. 1A. The channel or gutter 54 and the flexible ring cap 46 arrangement acts as a flexible annular seal at the upper end of the drive shaft 16. This flexible combination provides a novel first diversion to the motion and momentum to any water that may be driven towards the end ring cap 46, to prevent or minimize any intervention of water or contamination into the hub of the peeler or stripper bar 42.

The hub of the peeler or stripper bar 42 itself has an outwardly directed edge 56, having a downwardly extending flange 58 therearound. The upper flange 30 has an inner hub portion 60, having an uppermost peripheral ridge 62, thereon. The ridge 62 has an annular channel 64 arranged about its periphery, as may be seen in FIG. 1B. The downwardly directed flange 58 of the hub of the peeler bar 42 and the uppermost edge of the flange 58 of the hub 60 of the drum 26, have a narrow annular space arranged therebetween. There is relative motion between the hub 60 and radially extending finger of the peeler and stripper bar 42 at the upper end of the drum 26. A flexible annular L-shaped seal 66, shown in section in FIG. 1B, is snuggly arranged in the channel 64 within the rotatable hub 60 fixedly arranged on the top of the rotatable drum 26. The L-shaped seal 66 has a leg portion 68 extending radially outwardly therefrom, in rubbing sealing contact with the downwardly extending flange 58 at the periphery of the stationary peeler and stripper bar 42. The flexible L-shaped seal 66, acts as a flow restrictor to any contaminated sea water or environmental hazard which may try to infiltrate the area between the hub of the peeler and stripper bar 42 and the hub at the top of the drum 26. This second diversion thus further prevents infiltration of such contaminants, which might otherwise have a deleterious effect on the gearing mechanism within the drum 26, inner bearings and housing 20 of the present winch 10.

The drum 26 has an inner annular column 70, having a lower end 72 that is supported on bearings which rides on a hub portion 74 of the housing 20. The housing 20, as aforementioned, is fixedly attached to the base 12, which base 12 is of course fixedly attached to the deck or planking 14 of a ship or boat, in open exposure with any weather conditions. The lower annular rim 22 of housing 20, attached to the base 12, is of circular configuration. The rim 22 of the housing 20 and the base 12 to which it is secured, have an annular peripheral wall 76 with an annular groove 78, disposed therearound, as may be seen in section in FIG. 1, and more readily viewed in enlarged sectional view in FIG. 1C. The drum 26 has a lowermost protective overlapping flange or skirt 80, which skirt 80 overlaps and extends readily outwardly of the annular groove 78 on the rim 22 of the housing/base 20/12 in a protective manner. A generally "V" or "L"-shaped flexible annular seal 82 is snuggly mated within the annular groove 78 in the rim 22 of the housing/base 20/12. The flexible generally L-shaped seal 82 has a generally radially outwardly directed leg portion 84 which is in abutting, rubbing contact with the inner side of the skirt 80 extending downwardly from the lower end of the lower flange 28 of the drum 26. The flexible annular seal 82 arranged between the stationary rim 22 of the housing/base 20/12, and the rotatable peripheral skirt 80 radially thereadjacent, provides a third diversion arrangement as a further labyrinthian seal at the juncture of those components, providing a further barrier to infiltration of weather, salt, and seawater typically found in the environment to which the inventive winch is utilized.

Thus, what has been shown, is a novel channel and labyrinthian seal arrangement, to minimize the intrusion of environmental hazards into the inner workings of a marine winch. The seal arrangement is comprised of gutters or channels and or flexible barriers between adjacent spaced-apart components or respective moving parts, to provide protection for a marine winch, which is not shown or suggested in the art.

I claim:

1. An improved weather resistant marine winch arranged to permit the control of lines on a ship and to minimize water intrusion into said winch, said winch comprising:

a base for attachment to surface of the ship, said winch including a vertically oriented drive shaft supported over said base;

a cylindrically shaped drum rotatively disposed about said drive shaft, said drum having an upper drum flange and a lower drum flange, said upper drum flange having an upper hub portion on which an annular peeler bar is arranged, said peeler bar having a central bore with a shoulder therearound;

a ring cap fit about an upper end of said drive shaft, with a downwardly extending flange mating radially about said shoulder of said peeler bar; and an annular "U" shaped groove arranged about the outer periphery of said shoulder to divert any weather elements from infiltrating under said ring cap, thereby comprising a water diversion, protecting said winch from the weather.

2. The improved weather resistant marine winch as recited in claim 1, wherein said upper hub portion of said upper flange of said drum has an annular groove therearound, and said peeler bar has an annular lip or flange radially thereadjacent, said annular groove in said upper flange of said upper hub portion having a flexible annular seal, of "L" shape in cross-section extending between said hub portion and said flange of said peeler bar to seal weather from entry within the area between said peeler bar and said hub portion of said upper flange of said drum as a further diversion to water.

3. The improved weather resistant marine winch as recited in claim 1, wherein said lower flange of said drum has a downwardly extending skirt arranged in an overlapping relationship with a peripheral rim portion of said base;

an annular groove arranged in said peripheral rim portion of said base; and a flexible "L" shaped seal ring arranged in said annular groove in said peripheral portion of said base, having a leg segment thereof extending generally radially outwardly in contact with an inner side of said skirt, to provide a weather diversion sealing arrangement between lower flange of said drum and said base, to prevent weather intrusion therebetween.

4. An improved weather resistant marine winch arranged to permit the control of lines on a ship and to minimize water intrusion into said winch, said winch comprising:

a stationary base for attachment to surface of the ship, said winch including a vertically oriented drive shaft supported over said base;

a cylindrically shaped drum rotatively disposed about said drive shaft, said drum having an upper drum flange and a lower drum flange, said upper drum flange having an upper hub portion on which an annular peeler bar is arranged, said drum between said upper drum flange and said lower drum flange being arranged to receive line wrapped therearound for control of the line, said peeler bar having a central bore with a shoulder therearound;

a flexible ring cap fit about an upper end of said drive shaft, with a downwardly extending flange mating radially about said shoulder of said peeler bar;

an annular "U" shaped groove arranged about the outer periphery of said shoulder for diversion any weather elements from infiltrating under said ring cap, thereby protecting said winch from the weather;

wherein said upper hub portion of said upper flange has an annular groove therearound, and said peeler bar has an annular lip or flange radially thereadjacent, said annular groove in said upper flange of said upper hub portion having a flexible annular seal, of "L" shape in cross-section extending between said hub portion and said flange of said peeler bar for a further diversion of water, to seal weather from entry within the area between said peeler bar and said hub portion of said upper flange of said drum;

wherein said lower flange of said drum has a downwardly extending skirt arranged in an overlapping relationship with a peripheral rim portion of said base;

an annular groove arranged in said peripheral rim portion of said base; and a flexible "L" shaped seal ring arranged in said annular groove in said peripheral rim portion of said base, having a leg segment thereof extending generally radially outwardly, in contact with an inner side of said skirt, to provide a water diversion arrangement between lower flange of said rotatable drum and said stationary base, to prevent weather intrusion therebetween.

5. A method of improving the weather resistance of a marine winch arranged to permit the control of lines on a ship and to minimize water intrusion into said winch, said method comprising the steps of:

attaching a base of said winch to a surface of the ship, said winch including a vertically oriented drive shaft supported in a housing over said base;

arranging a cylindrically shaped rotatable drum about said drive shaft, said drum having an upper drum flange and a lower drum flange to define an annular area for receipt of line therearound, said upper drum flange having an upper hub portion on which an annular peeler bar is arranged for assisting line control wrapped about said drum, said peeler bar having a central bore with a shoulder therearound;

mating a flexible ring cap fit about an upper end of said drive shaft, with a downwardly extending flange mating radially about said shoulder of said peeler bar;

manufacturing an annular "U" shaped groove arranged about the outer periphery of said shoulder of said peeler bar, so as to act in biased combination with said flexible ring cap to divert any weather elements from infiltrating under said ring cap, thereby comprising a water diversion, protecting said winch from the weather;

wherein said upper hub portion of said upper flange of said drum has an annular groove therearound, and said peeler bar has an annular lip or flange radially thereadjacent, said annular groove in said upper flange of said upper hub portion having a flexible annular seal, of "L" shape in cross-section extending between said hub portion and said flange of said peeler bar to seal weather from entry within the area between said peeler bar and said hub portion of said upper flange of said drum as a diversion to water intrusion; and wrapping a line about said drum between said upper and lower flanges, and over said peeler bar for control of the line, said diversion to water intrusion helping maintain said winch capabilities in a marine environment.

6. The method of improving the weather resistance of a marine winch arranged to permit the control of lines on a ship and to minimize water intrusion into said winch as recited in claim 5, including the step of:

arranging an annular flexible seal spaced between said base and said lower flange to prevent water intrusion therebetween, to harm the internal mechanism of said marine winch.

7. The method of improving the weather resistance of a marine winch arranged to permit the control of lines on a ship and to minimize water intrusion into said winch, as recited in claim 6, including the step of:

inserting a second flexible annular seal in an annular groove in a hub of said upper flange, said second annular seal arranged in rubbing contact with a downwardly directed rim portion of said peeler bar, said second annular seal preventing water intrusion from between said hub of said upper flange and said peeler bar, thus helping to maintain the effectiveness of said marine winch in a marine environment.

* * * * *